US010975740B2

(12) United States Patent
Daniel et al.

(10) Patent No.: US 10,975,740 B2
(45) Date of Patent: Apr. 13, 2021

(54) AIRCRAFT ENGINE OIL FILLER APPARATUS

(71) Applicant: PRATT & WHITNEY CANADA CORP., Longueuil (CA)

(72) Inventors: Marion Daniel, Verdun (CA); Sean Powers, Candiac (CA); Rose Beaulieu, Longueuil (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 16/460,609

(22) Filed: Jul. 2, 2019

(65) Prior Publication Data

US 2021/0003051 A1 Jan. 7, 2021

(51) Int. Cl.
*F01M 11/04* (2006.01)

(52) U.S. Cl.
CPC ..... *F01M 11/04* (2013.01)

(58) Field of Classification Search
CPC ..... F01M 11/04; B60K 2015/03289
USPC ..... 141/199, 212, 213
See application file for complete search history.

(56) References Cited

U.S. PATENT DOCUMENTS

| | | | |
|---|---|---|---|
| 4,299,307 A | 11/1981 | Scott | |
| 4,337,657 A | 7/1982 | Morris | |
| 4,386,337 A | 5/1983 | Todd | |
| 4,480,718 A | 11/1984 | Marinelli | |
| 4,572,097 A | 2/1986 | Lansinger et al. | |
| 4,819,484 A | 4/1989 | White | |
| 4,910,495 A | 3/1990 | Sullivan | |
| 4,989,560 A | 2/1991 | Rasdal et al. | |
| 5,141,019 A | 8/1992 | LeBlanc et al. | |
| 5,299,456 A | 4/1994 | Steiner | |
| 5,327,997 A | 7/1994 | Nash, Jr. et al. | |
| 5,950,692 A * | 9/1999 | Georgs | B60K 15/04 137/408 |
| 6,564,822 B2 | 5/2003 | Muto et al. | |
| 6,926,121 B2 | 8/2005 | Gates et al. | |
| 7,089,974 B2 | 8/2006 | Stuart | |
| 7,486,179 B2 | 2/2009 | McCormick et al. | |
| 7,509,753 B2 | 3/2009 | Nicosia et al. | |

(Continued)

FOREIGN PATENT DOCUMENTS

| | | |
|---|---|---|
| CA | 1214697 A1 | 12/1986 |
| DE | 2420019 A1 | 11/1975 |

(Continued)

*Primary Examiner* — Jason K Niesz
(74) *Attorney, Agent, or Firm* — Norton Rose Fulbright Canada LLP

(57) ABSTRACT

An aircraft engine oil filler apparatus includes a filler tube configured to be received through a wall of an oil tank such that an open upper end of the filler tube is accessible from outside of the oil tank and a bottom end of the filler tube is disposed inside the oil tank, a valve received in the bottom end of the filler tube and movable between an open position in which the valve hydraulically connects the filler tube to the oil tank, and a closed position in which the valve hydraulically disconnects the filler tube from the oil tank, and a float disposed above the valve and operatively connected to the valve to move the valve from the open position to the closed position when oil inside the oil tank rises to a predetermined level. A method of operation of an oil filler apparatus is also described.

18 Claims, 10 Drawing Sheets

(56) References Cited

U.S. PATENT DOCUMENTS

| | | | |
|---|---|---|---|
| 8,376,088 | B2 | 2/2013 | Rollins et al. |
| 8,464,764 | B1 * | 6/2013 | Milsom ..... B60K 15/03519 137/202 |
| 9,587,533 | B2 | 3/2017 | Noguchi |
| 2003/0188576 | A1 | 10/2003 | Park |
| 2009/0101230 | A1 | 4/2009 | Anstead et al. |
| 2010/0179747 | A1 | 7/2010 | McCormick et al. |
| 2012/0097482 | A1 | 4/2012 | Miller et al. |

FOREIGN PATENT DOCUMENTS

| | | | |
|---|---|---|---|
| DE | 2552769 | A1 | 5/1977 |
| DE | 4105529 | A1 | 8/1992 |
| DE | 4117400 | C2 | 12/1993 |
| DE | 102004029264 | A1 | 1/2006 |
| DE | 102014111323 | A1 | 4/2015 |
| FR | 2691251 | A1 | 11/1993 |
| GB | 955031 | A | 4/1964 |

* cited by examiner

P1 (ambiant pressure in tank during operation) P1>P0

AIRCRAFT ENGINE OIL FILLER APPARATUS

TECHNICAL FIELD

The application relates to aircraft engine oil filler apparatuses.

BACKGROUND OF THE ART

A common design of prior art aircraft engine oil tanks puts the filler neck at such a level that if someone tries to overfill the oil tank, oil spills through the filler neck. Another typical prior art aircraft engine oil tank includes a valve at a filler tube inlet, which valve floats in oil to close the inlet when the oil level is high enough. However, in such prior art oil tanks the float obstructs the filler tube inlet and render problematic the use of a dipstick as mechanical oil level indicator. Therefore, while prior art oil tanks are suitable for their intended purposes, improvements can be made.

SUMMARY

In one aspect, there is provided an aircraft engine oil filler apparatus, comprising: a filler tube configured to be received through a wall of an oil tank of an aircraft engine such that an open upper end of the filler tube is accessible from outside of the oil tank and a bottom end of the filler tube is disposed inside the oil tank; a valve received at least in part in the bottom end of the filler tube and movable between an open position in which the valve hydraulically connects the filler tube to the oil tank, and a closed position in which the valve hydraulically disconnects the filler tube from the oil tank; and a float disposed above the valve and operatively connected to the valve to move the valve from the open position to the closed position when oil inside the oil tank rises to a predetermined level.

In some embodiments, the aircraft engine oil filler apparatus comprises a link connecting the float to the valve.

In some embodiments, the valve includes a ball and a rod translationally received in the filler tube, the rod being connected to the link to translate relative to the filler tube with the float.

In some embodiments, the filler tube defines an aperture in the filler tube below the float and the valve includes a closure member disposed below the aperture when the valve is in the open position.

In some embodiments, the aircraft engine oil filler apparatus comprises a seat disposed inside the filler tube above the aperture, and the closure member is received in the seat and thereby blocks the filler tube above the aperture when the valve is in the closed position.

In some embodiments, the aircraft engine oil filler apparatus comprises a dipstick removably received in the filler tube, the dipstick having a length selected such that a bottom end of the dipstick is disposed above the seat.

In another aspect, there is provided an oil tank of an aircraft engine, comprising: a filler tube received through a wall of the oil tank such that an upper end of the filler tube is accessible from outside of the oil tank and a bottom end of the filler tube is disposed inside the oil tank, the filler tube defining apertures in the bottom end; a valve received at least in part in the bottom end of the filler tube, the valve being operable between an open position in which the valve hydraulically connects a portion of the filler tube above the apertures to the inside of the oil tank via the apertures, and a closed position in which the valve blocks the apertures and thereby hydraulically disconnects the portion of the filler tube above the apertures from the inside of the oil tank; and a float disposed inside the oil tank above the valve and operatively connected to the valve to move the valve from the open position to the closed position when oil inside the oil tank rises to a predetermined level.

In some embodiments, the valve is disposed below the apertures when in the open position and above the apertures when in the closed position.

In some embodiments, the oil tank comprises a dipstick removably received in the filler tube such that a bottom end of the dipstick is above the valve both when the valve is in the open position and when the valve is in the closed position.

In another aspect, there is provided a method of operation of an oil filler apparatus, comprising: receiving oil into a filler tube of the oil filler apparatus inserted at least in part into an oil tank of an aircraft, defining a fluid connection between a bottom end of the filler tube and the oil tank for oil to flow through the filler tube to the oil tank; maintaining oil in the filler tube when the oil in the oil tank is above the bottom end of the filler tube; and fluidly disconnecting the bottom end of the filler tube from the oil tank when the oil in the oil tank reaches a threshold that is above the bottom end of the filler tube.

In some embodiments, the fluidly disconnecting the bottom end of the filler tube from the oil tank includes seating a closure member against the filler tube.

In some embodiments, the seating the closure member includes translating the closure member.

In some embodiments, the seating the closure member includes blocking an inner diameter of the filler tube.

In some embodiments, the seating the closure member includes telescoping a piston relative to the filler tube.

In some embodiments, the telescoping the piston includes translating a rod in the bottom end of the filler tube.

In some embodiments, the telescoping the piston includes applying a buoyancy force to the rod to push the closure member with the rod.

In some embodiments, the method comprises hydraulically disconnecting the filler tube from the oil tank when pressure in the filler tube is smaller than pressure in the rod.

In some embodiments, the method comprises receiving a dipstick in the filler tube after the receiving oil into the filler tube but before the fluidly disconnecting the bottom end of the filler tube from the oil tank.

In some embodiments, the receiving the dipstick occurs after fluidly disconnecting the bottom end of the filler tube from the oil tank.

In some embodiments, the method comprises receiving a cap on the filler tube and wherein the receiving the cap includes receiving the dipstick in the filler tube.

DESCRIPTION OF THE DRAWINGS

Reference is now made to the accompanying figures in which.

DETAILED DESCRIPTION

Figure 1A:
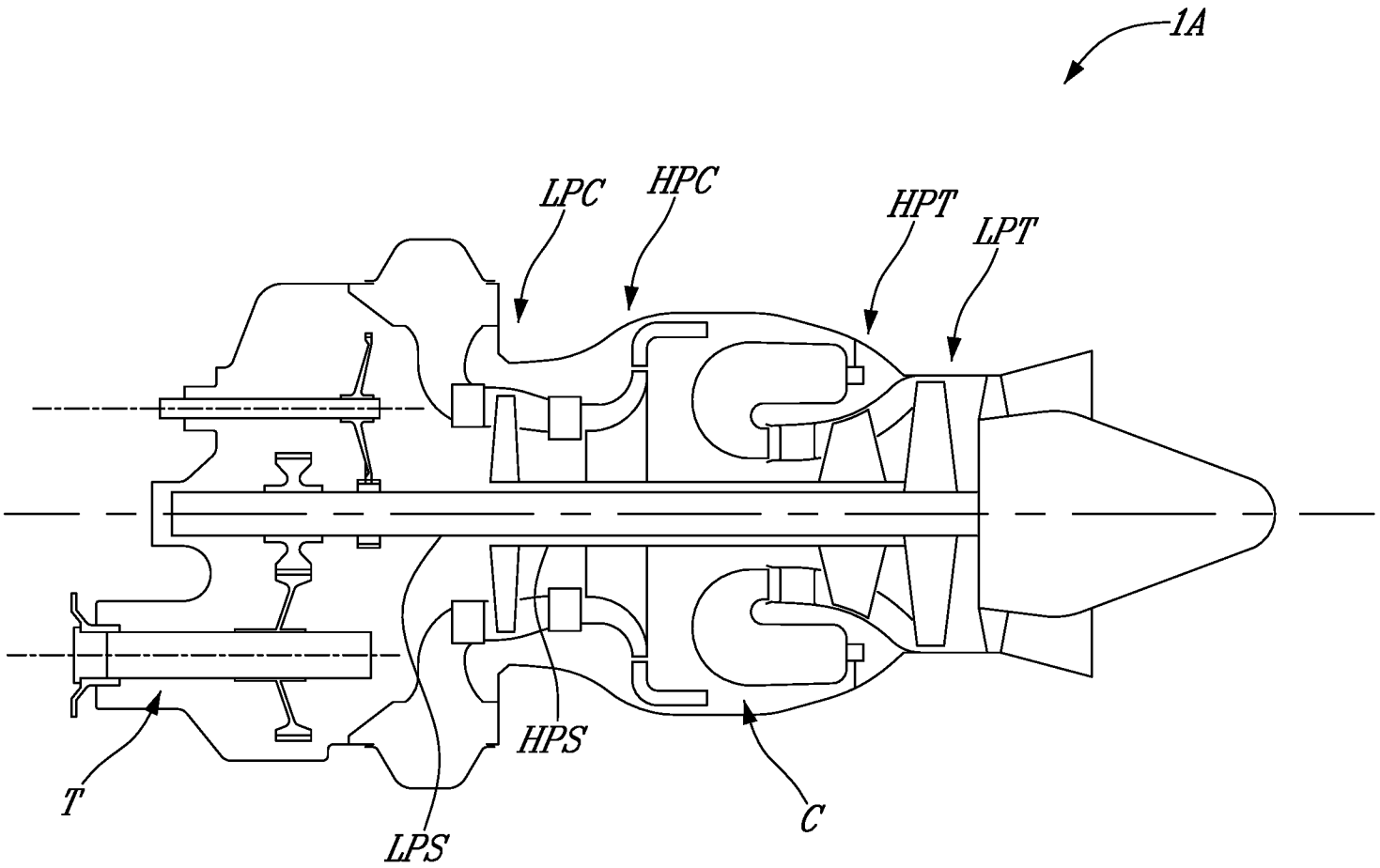
FIG. 1A is a schematic cross sectional view of an aircraft engine.

FIG. 1A illustrates an aircraft engine 1A, which may be part of an aircraft, such as a conventional aircraft for example. In this example, the engine 1A is a turboshaft engine 1A, but could be any other type of aircraft engine. In this embodiment, the engine 1A includes in serial flow communication a low pressure compressor section (LPC) and a high pressure compressor section (HPC) for pressurizing air, a combustor (C) in which the compressed air is mixed with fuel and ignited for generating an annular stream of hot combustion gases, a high pressure turbine section (HPT), and a lower pressure turbine section (LPT). The respective pairs of the compressor and turbine sections are interconnected via respective independently rotatable low pressure and high pressure spools (LPS), (HPS). The engine 1A includes a transmission (T) driven by the low pressure turbine section (LPT) for outputting motive power to an aircraft.

Figure 1B:
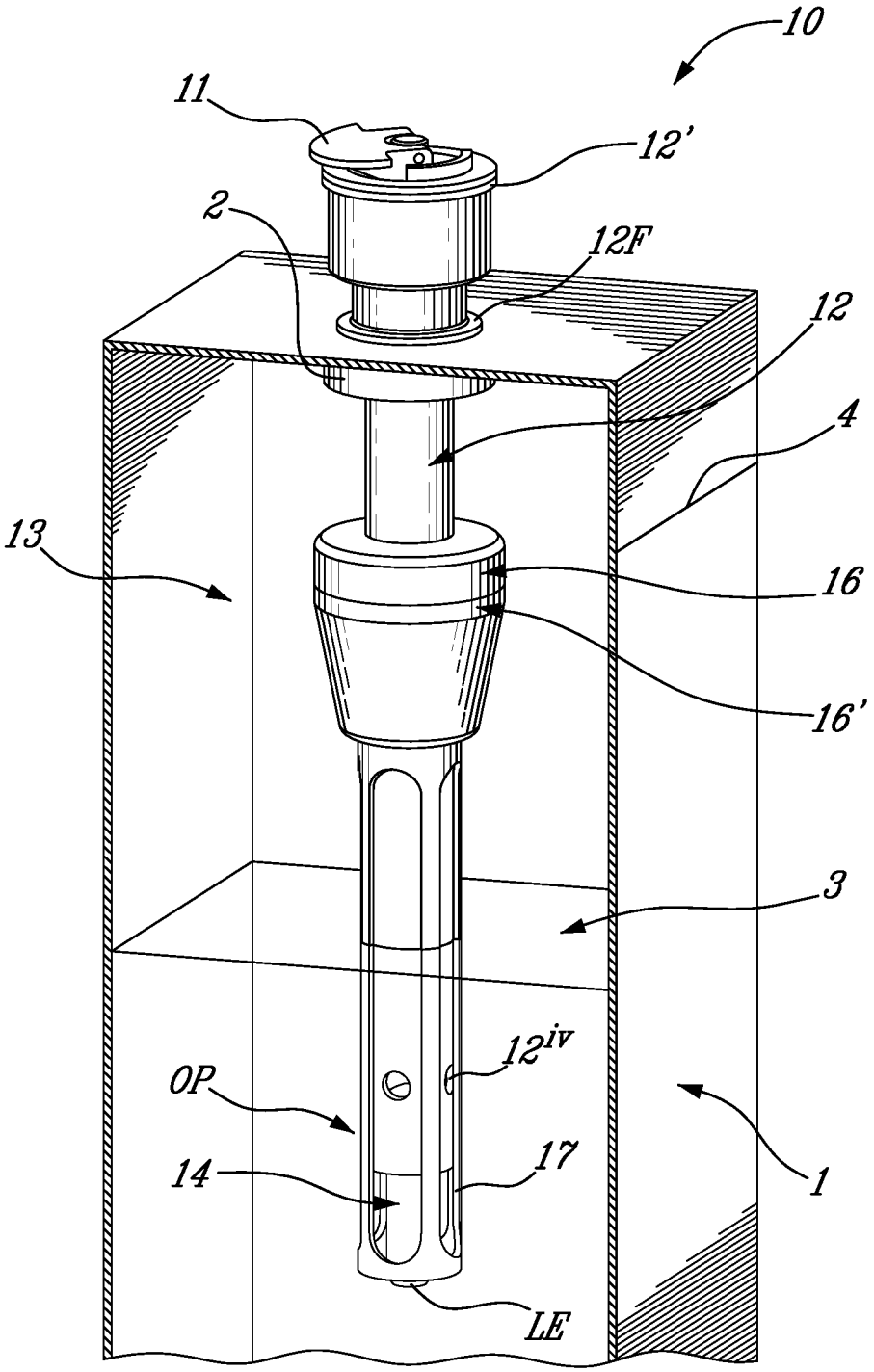
FIG. 1B is a schematic cross sectional view of an oil tank of the aircraft engine of FIG. 1A, showing an aircraft engine oil filler apparatus of the oil tank.

FIG. 1B illustrates an oil tank 1 of an aircraft engine, such as the turboshaft engine 1A. The oil tank 1 may be, for example, part of an oil system of the engine 1A and may be connected to the oil system via, for example, any conventional connectors. Accordingly, these aspects of the oil tank 1 and the oil system are not shown or described in detail. The oil system may be any oil system. Still referring to FIG. 1B, the oil tank 1 defines an opening 2. In the present embodiment, the opening 2 may be delimited by a cylindrical and threaded tube portion or wall, but may be of a different shape and/or construction. The opening 2 receives therethrough an aircraft engine oil filler apparatus 10. As described in detail below, in the illustrated embodiment, the aircraft engine oil filler apparatus 10 may allow oil 3 to be added into the oil tank 1, may prevent the oil tank 1 from being filled to above a pre-determined oil level 4, may prevent or at least reduces risk of spillage of oil 3 out of the oil tank 1 when the oil tank 1 is in use, and/or may allow a dipstick to be used to measure the level of oil 3 in the oil tank 1 at least while the oil level is below the pre-determined oil level 4. In other embodiments, the aircraft engine oil filler apparatus 10 may have a different set of functionalities.

Figure 2:
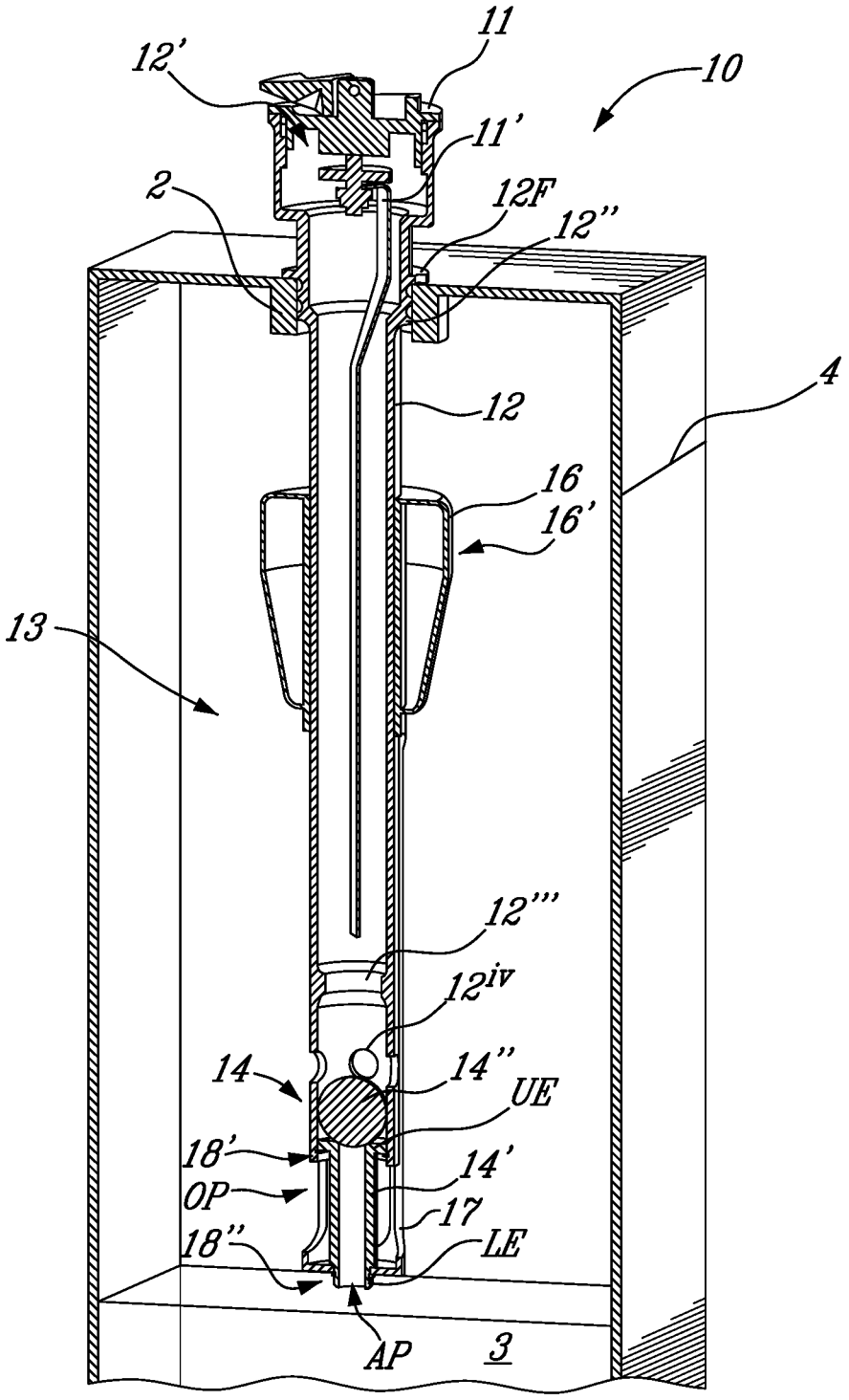
FIG. 2 is a schematic cross sectional view of the oil tank and the aircraft engine oil filler apparatus of FIG. 1, with oil in the oil tank being at a first level and a valve of the aircraft engine oil filler apparatus being in an open position.

In the present embodiment, the aircraft engine oil filler apparatus 10 includes a cap 11 structured to removably attach to an open upper end 12' of a filler tube 12 to cover the upper open end 12' of the filler tube 12 when the oil tank 1 is in use, and to be removable from the filler tube 12 to allow for oil 3 to be added to the oil tank 1 via the filler tube 12. To this end, and as shown in FIGS. 1 and 2, the cap 11 includes a securement mechanism coupled to a lever on top of the cap 11. This structure allows the cap 11 to be received into or taken out of the upper open end 12' of the filler tube 12 while the lever is lifted. The lever may be manually pivoted to a closed position while the cap 11 is in the upper end 12' of the filler tube 12, such as shown in FIG. 1 for example, to cause the securement mechanism to removably secure the cap 11 in the open upper end 12'. The securement mechanism may be a conventional securement mechanism (i.e., not necessarily one with a lever), may be any other suitable securement mechanism, and is therefore not described in more detail herein. An example of other securement mechanism is threading.

Referring to FIG. 2, in this embodiment, the cap 11 includes a dipstick 11' that is attached to a bottom of the cap 11. The dipstick 11' extends into the filler tube 12 when the cap 11 is removably attached to the upper open end 12' of the filler tube 12. A length of the dipstick 11' is selected to suit each particular embodiment of the oil tank 1 and its application, to allow a user to determine a level of oil in the oil tank 1. Moreover, the dipstick 11' may have graduated marks indicative of a level of oil. In other embodiments, the dipstick 11' may be detachable from the cap 11 and/or may be separate from the cap 11. In some such alternative embodiments, the filler tube 12 may define an additional aperture/opening in its upper end 12', for receiving the dipstick 11' through that additional aperture/opening. In some cases, such an alternative construction may allow the dipstick 11' to remain inserted in the filler tube 12 while the cap 11 is removed from the filler tube 12 to allow for oil 3 or other substance to be poured into the filler tube 12.

Still referring to FIG. 2, in the present embodiment, the filler tube 12 includes a cylindrical neck portion 12" that is shaped to be mateably received into the opening 2 in the oil tank 1 via friction fit to form a liquid-tight interface with the surface(s) of the fuel tank 1 defining the opening 2. As shown, in this embodiment, the filler tube 12 defines an abutment flange 12F at a top of the cylindrical neck portion 12", which facilitates the insertion of the filler tube 12 into the opening 2 by preventing over-insertion into the opening 2. In other embodiments, the abutment flange 12F may be omitted. In other embodiments, the filler tube 12 and/or the opening 2 may have different complementary shapes and/or may be structured for a different type of mating connection, such as a clip-in or a threaded connection for example. In yet other embodiments, the filler tube 12 and the oil tank 1 may be integral to each other.

When in place in the oil tank 1 as shown, the filler tube 12 extends into the oil tank 1, with part of the filler tube 12 remaining disposed outside of the oil tank 1. In other embodiments, the filler tube 12 may be structured to be disposed at least substantially in its entirety at or below an outer surface of the oil tank 1. In this embodiment, the length of the dipstick 11' is selected such that a bottom end of the dipstick 11' is disposed above a seat 12'" that is disposed inside the filler tube 12. As described in more detail below, in the illustrated embodiment, the seat 12''' allows for the filler tube 12 to be selectively hydraulically disconnected from the oil tank 1 to prevent overfill.

In the present embodiment, it is an inner surface of the filler tube 12 that defines the seat 12''' in its bottom half, for instance by an integral rib. However, it is contemplated that the seat 12''' may be a separate element coupled to the inside of the filler tube 12. The position of the seat 12''' inside the filler tube 12 is selected to allow the cap 11 to be removably secured to the open upper end 12' of the filler tube 12 with the dipstick 11' being attached to the cap 11 and disposed in its entirety above the seat 12''', without being an interference for the dipstick 11' when the valve 14 (described below) is seated against the seat 12'''. Stated otherwise, the position of the seat 12''' inside the filler tube 12 is selected to be sufficiently low in the filler tube 12 so as to not interfere with the insertion of the dipstick 11' into the filler tube 12.

Below the seat 12''', the filler tube 12 defines one or more apertures $\mathbf{12}^{iv}$ therein, and more particularly through a wall of the filler tube 12. In some embodiments, a single aperture $\mathbf{12}^{iv}$ may be used. As described in more detail below, the apertures $\mathbf{12}^{iv}$ allow for oil 3 poured into the open upper end 12' of the filler tube 12 while the cap 11 is removed to enter the oil tank 1. The apertures $\mathbf{12}^{iv}$ may also allow an equalization of pressure between the ambient environment outside of the oil tank 1 and pressure inside the oil tank 1 while both of the following conditions are true: i) the cap 11 is removed from the upper open end 12' of the filler tube 12 (i.e. moved to open/unseal the upper open end 12' of the filler tube 12), and ii) the level of oil 3 inside the oil tank 1 is below the pre-determined oil level 4 (described in detail below).

As shown in FIGS. 2 to 5, the filler tube 12 defines multiple apertures $\mathbf{12}^{iv}$ circumferentially around the wall of the filler tube 12 in a single plane transverse to that part of the filler tube 12. However, it is contemplated that any other number and/or arrangement may be used, so long as the aperture(s) $\mathbf{12}^{iv}$ is/are below the seat 12''' and the functionality of the aircraft engine oil filler apparatus 10 as described herein is provided.

Still referring to FIG. 2, in the present embodiment, the aircraft engine oil filler apparatus 10 includes a telescoping piston 13 operatively connected to a valve 14. Together, the telescoping piston 13 and the valve 14 are operable to provide one or more of, and in some embodiments all of, the following: a) to allow oil 3 to be added into the oil tank 1 via the aperture(s) $\mathbf{12}^{iv}$ while the cap 11 is removed from the upper open end 12' of the filler tube 12 (i.e. moved to open/unseal the upper open end 12' of the filler tube 12) and while oil 3 inside the oil tank 1 is below the pre-determined oil level 4, b) while the oil tank 1 is being filled, for the rising oil level in the oil tank 1 to be at least approximately equal to the oil level inside the filler tube 12 after the oil 3 in the oil tank 1 reaches the filler tube 12 and at least until the oil 3 in the oil tank 1 reaches the pre-determined oil level 4, c) to hydraulically disconnect the filler tube 12 from the oil tank 1 by blocking off the aperture(s) $\mathbf{12}^{iv}$, and more particularly in this embodiment by seating the ball 14" against the seat 12''', when the oil 3 in the oil tank 1 has reached the pre-determined oil level 4, and/or d) to hydraulically disconnect the filler tube 12 from the oil tank 1, by seating the ball 14" against the seat 12''' in this embodiment, when pressure in the filler tube 12 is smaller than pressure in the oil tank 1, such as when the cap 11 is mis-installed or missing in operation for example, as shown in FIG. 5B.

The telescoping piston 13 and the valve 14 may enable one or more of, and in some embodiments all of, the above functions while allowing the dipstick 11' to be inserted into the filler tube 12 independent of the position of the telescoping piston 13 and the valve 14, for checking oil level inside the oil tank 1 by checking the oil level inside the filler tube 12. The telescoping piston 13 and the valve 14 are described in more detail next.

Referring to FIG. 2, the telescoping piston 13 includes at least one float 16 translationally connected to, and in this embodiment translationally received over, the filler tube 12 above the valve 14. The telescoping piston 13 also includes at least one link 17 that, at least in this embodiment, is/are translationally received over the filler tube 12. The link(s) 17 operatively connect(s) the valve 14 to the float 16. More particularly, and referring briefly back to FIG. 1, in the present embodiment the float 16 and the links 17 define a central aperture into which the filler tube 12 is received as shown in FIG. 1. The central aperture is sized, at least along a respective portion of its length for example, slightly larger than an outer diameter of the filler tube 12 to allow the float 16 and the links 17 to translate up or down relative to the filler tube 12. It is contemplated that a different construction providing for a translational joint between the filler tube 12 and the float 16 and links 17 (i.e. the telescoping piston 13) may be used.

In this embodiment, the float 16 and the links 17 are injection molded from a plastic, and are integral to each other, with the float 16 containing air that provides floatation as described herein. In other embodiments, other constructions and/or materials (e.g., metal, composites) and/or manufacturing methods may be used. For example, the float 16 may be made from a material that floats in the oil 3, or other substance for which the tank 1 may be designed, to provide for the functionality as described in this document. As another example, the float 16 may be a separate part from and may be attached to the links 17. As another example, a different type of link(s) 17, such as length-adjustable links, may be used.

Figure 3A:
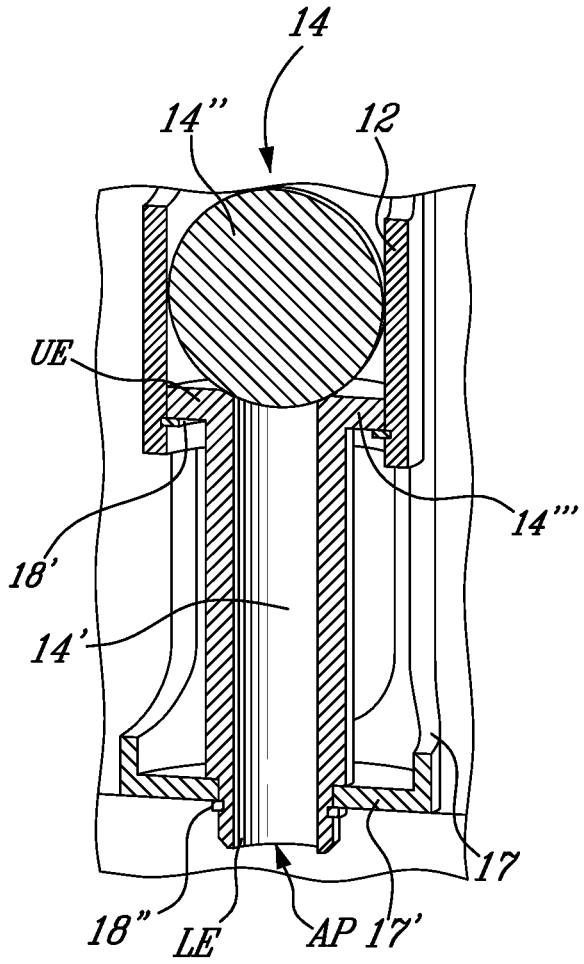
FIG. 3A is a close-up schematic cross sectional view of a part of the valve of the aircraft engine oil filler apparatus of FIG. 1.

Referring to both FIGS. 2 and 3A, in this embodiment, the valve 14 is translationally received in a bottom end of the filler tube 12. As shown, the valve 14 has an open position (OP) in which the valve 14 hydraulically connects the filler tube 12, and more particularly in this embodiment the portion of the filler tube above the seat 12''', to the oil tank 1. To this end, in this embodiment, the valve 14 includes a rod 14' and a ball 14". The rod 14' in this embodiment is hollow (i.e. defines an aperture (AP) axially therethrough, the aperture (AP) extending between opposed ends (UE), (LE) of the rod 14', with at least the upper end (UE) being inside the filler tube 12), and is translationally received in the bottom end of filler tube 12 and forms a translational joint with the filler tube 12, which allows the valve 14 to translate inside the filler tube 12 as described in more detail below. The ball 14" is disposed on a top end of the rod 14' and is below the aperture(s) $\mathbf{12}^{iv}$ when the valve 14 is in the open position (OP) so as to hydraulically connect the filler tube 12 to the oil tank 1. In other embodiments, the valve 14 may be a pivotable valve 14 that may pivot relative to the filler tube 12 to provide for the functionality described herein.

In this embodiment, the ball 14" is not connected to the rod 14'. In an aspect, the decoupled relationship between the rod 14' and the ball 14" helps align the ball 14" with the seat 12''', and helps provide the function e) described herein above. However, in other embodiments, the ball 14" may be attached to, or integral with, the rod 14'. In yet other embodiments, the valve 14 may have a different construction so long as the functionality of the valve 14 as described herein is provided. For example, the rod 14' may be solid. As another example, in some embodiments, the ball 14" may instead be a conical or a frusto-conical member. In other words, the ball 14" is one example of a closure member that may be used. A different closure member having a different shape may be used to provide for the functionality of the valve 14 as described herein.

In this embodiment, the open position (OP) of the valve 14 is delimited by a circular clip 18', or equivalent abutment, removably received in a corresponding circumferential recess defined in the inner surface of the filler tube 12. The circular clip 18' serves as a stopper, or ledge, upon which a head 14''' of the rod 14' of the valve 14 rests when in the open position (OP), and which prevents the rod 14' from moving down past the open position (OP) and thus prevents the rod 14' from falling out of the bottom end of the filler tube 12. It is contemplated that any other stopper or ledge may be used to define the open position (OP) of the valve 14.

Figure 3B:
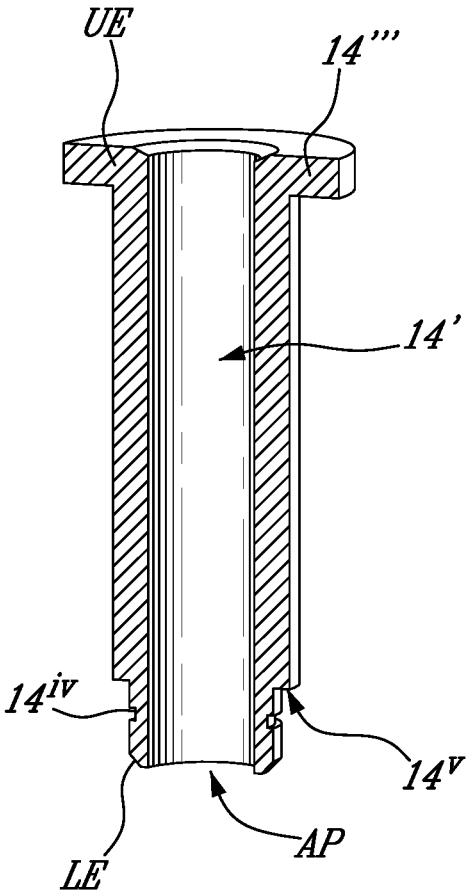
FIG. 3B is a close-up schematic cross sectional view of a rod of the valve of FIG. 3A.

As best shown in FIGS. 3A and 3B, at its bottom end the rod 14' is rigidly connected to the links 17 so that when the float 16 moves up relative to the filler tube 12, the links apply a corresponding upward force to the rod 14' and thereby move the rod 14' and the ball 14" from the open position (OP) upward toward the seat 12'''. In this embodiment, the connection between the rod 14' and the links 17 is provided via a piston interface 17' defined at the bottom ends of the links 17 and a clip 18" received in a circumferential recess 14" (FIG. 3B) defined in the outer surface of the rod 14' below the piston interface 17'. Although the present construction provides for an ease of manufacturing and assembly, it is contemplated that any other suitable connection between the valve 14 and the link(s) 17 may be used, such as a through fastener, pin, etc. In some such alternative embodiments, the other suitable connector(s) may be hollow similar to the rod 14", to help provide for the function e) described above.

In the present embodiment, the links 17 join at their bottom ends to define the piston interface 17', which in this embodiment is a planar circular push member 17' that generally conforms to a cross-section of the bottom end of the filler tube 12. The planar circular push member 17' defines an aperture therethrough, which may be coaxial with the rod 14' and the opening in the bottom end of the filler tube 12. As best shown in FIG. 3B, the bottom end of the rod 14' includes a narrower portion received in the aperture in the planar circular push member 17', and a wider portion that defines a circumferential push surface 14' that rests on the planar circular push member 17' of the links 17. Threading engagement is contemplated as an alternative.

The planar circular push member 17' pushes up against the circumferential push surface 14" to move the rod 14' and the ball 14" upward inside the filler tube 12 when the float 16 is moved upward relative to the filler tube 12 by a rising level of oil 3 in the oil tank 1 when the oil tank 1 is being filled. The clip 18" is disposed below the planar circular push member 17' and in some embodiments may help prevent the rod 14' from accidentally exiting the aperture in the planar circular push member 17'. The clip 18" may also help retain the link 17 and the float 16 to prevent these elements from moving down to the bottom of the oil tank 1. In other embodiments, a different retaining member may be used instead of or in addition to the clip 18". The present construction provides for ease of assembly and manufacturing of the telescoping piston 13. However, a different operative connection between the rod 14' and the links 17, and/or a different number of links 17, such as a single link 17 for example, may be used.

As shown in FIGS. 2 to 5, in the present embodiment, the rod 14' and the ball 14" are sized such that when the valve 14 is in the open position (OP), the ball 14" is at least in part below at least one of the aperture(s) 12' and is disposed below the seat 12'''. This position of the ball 14" does not impede the fluid communication between the filler tube 12 and the inside of the oil tank 1 via the open aperture(s) $\mathbf{12}^{iv}$. The fluid communication allows the filling and pressure equalization functions of the aircraft engine oil filler apparatus 10 as described herein.

Figure 4:
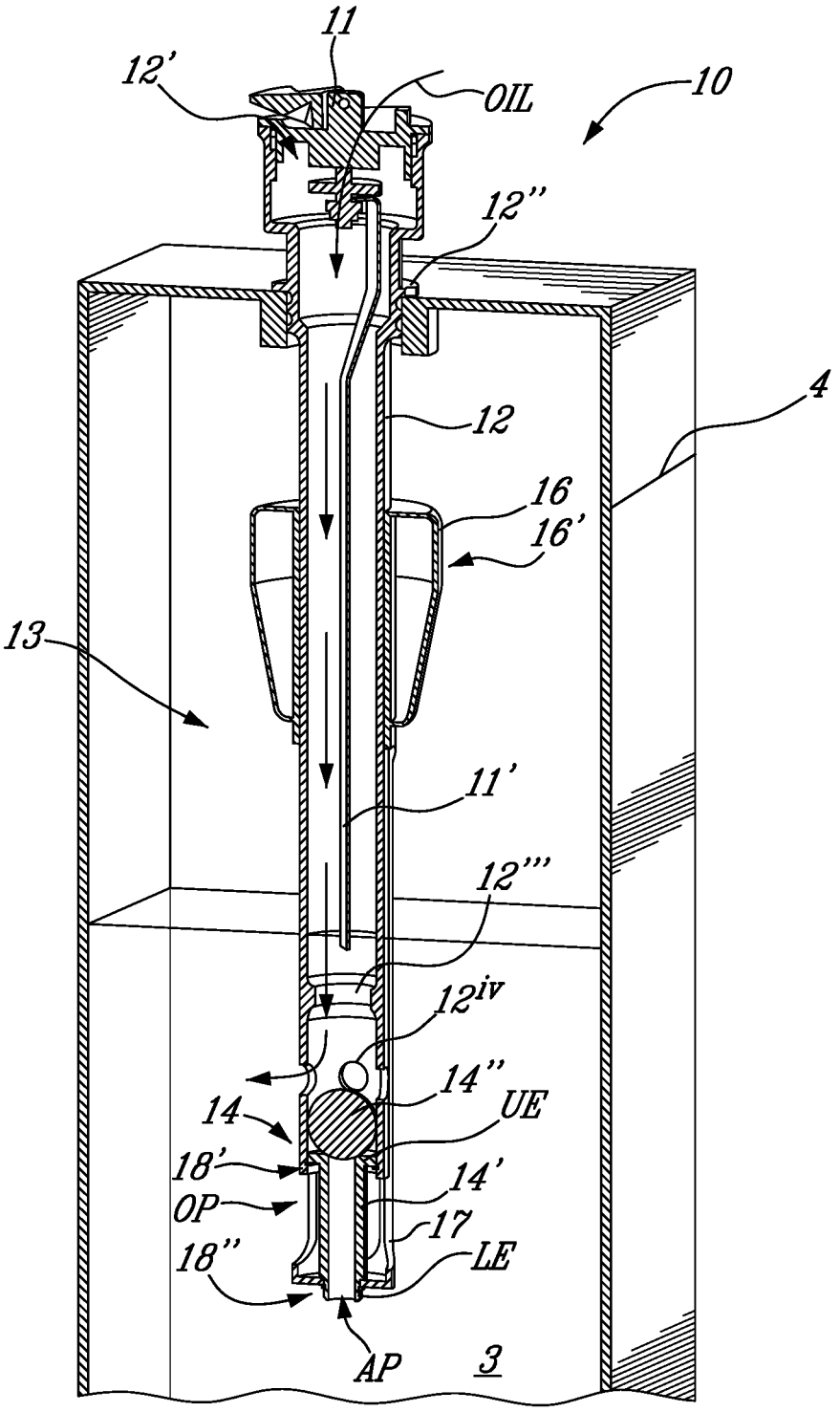
FIG. 4 is a schematic cross sectional view of the oil tank and the aircraft engine oil filler apparatus of FIG. 1, with oil in the oil tank being at a second level and the valve being in the open position.

More particularly, as shown in FIG. 4, the length of the rod 14', the size of the ball 14", the size and floating characteristics of the float 16, and the length of the filler tube 12 and the link(s) 17 are selected relative to each other and relative to the dimensions of the oil tank 1 so that when the level of oil 3 in the oil tank 1 is below the pre-determined oil level 4, the valve 14 is in the open position (OP) and thus hydraulically connects the filler tube 12 to the inside of the oil tank 1. In this position, the cap 11 with the dipstick 11' may be removed from the filler tube 12, and oil 3 may be poured into the oil tank 1 via the upper open end 12' of the filler tube 12.

As shown with arrows (OIL), as oil 3 is being poured into the filler tube 12, the oil 3 flows through the filler tube 12 and into the oil tank 1 via the open aperture(s) 12", with the valve 14 remaining at least approximately in its open position (OP). It should be noted that, depending on the particular embodiment of the telescoping piston 13 for example, while oil 3 is being poured in, some movement of the valve 14 relative to its open position (OP) without materially obstructing the aperture(s) $\mathbf{12}^{iv}$ may occur, and may be acceptable.

As can be seen from FIGS. 4 and 5, the fluid communication to the inside of the oil tank 1 provides a pressure-equalizing connection between the atmosphere and the inside of the oil tank 1. As a result, while the hydraulic connection exists, the level of oil 3 inside the oil tank 1 may be equal to the level of oil inside the filler tube 12. This effect, combined with the structure described above, allows a user to insert the dipstick 11' into the filler tube 12 and then take the dipstick out 11' to obtain an indication of the oil level inside the oil tank 1.

Figure 5A:
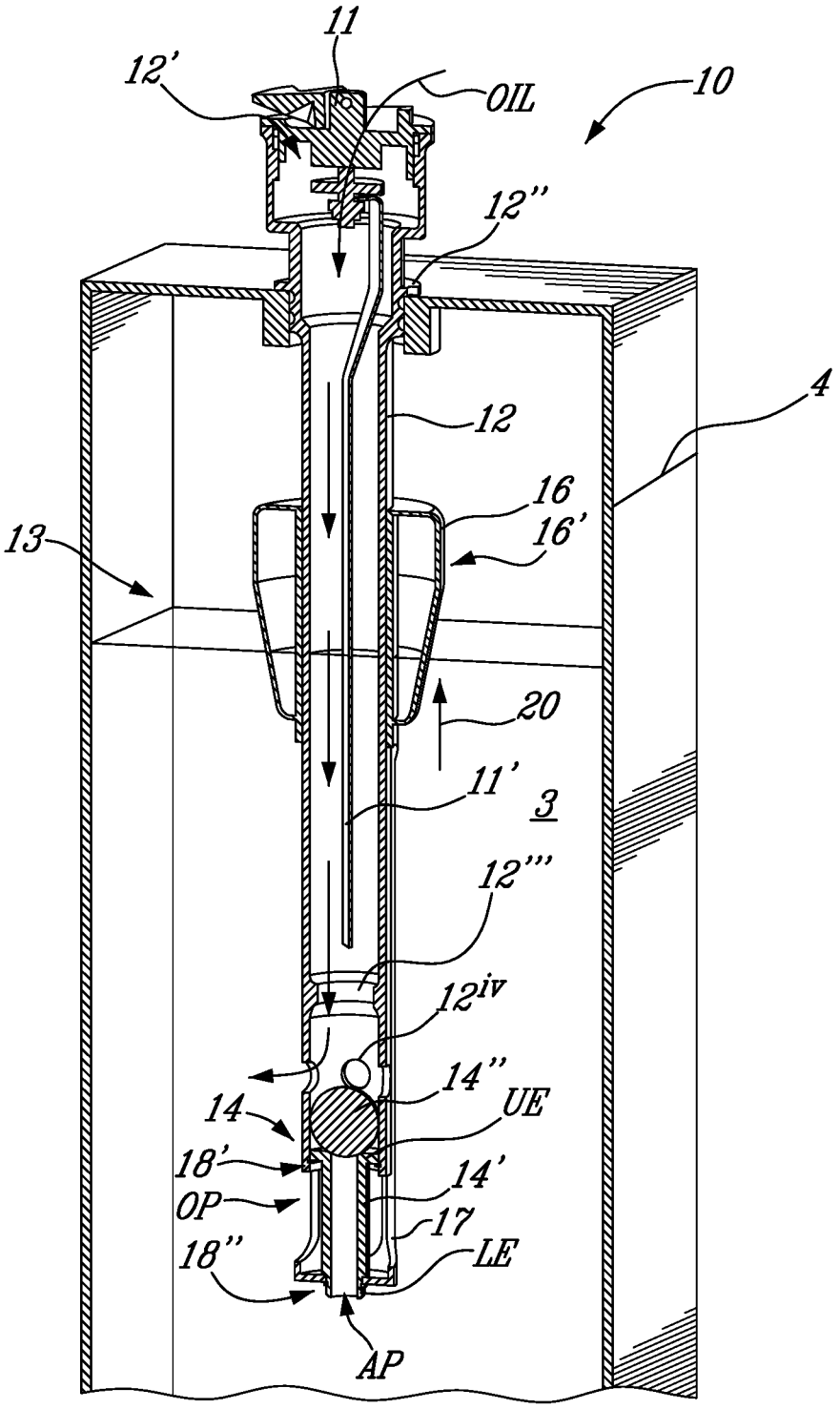
FIG. 5A is a schematic cross sectional view of the oil tank and the aircraft engine oil filler apparatus of FIG. 1, with oil in the oil tank being at a third level and the valve being in the open position.
Figure 5B:
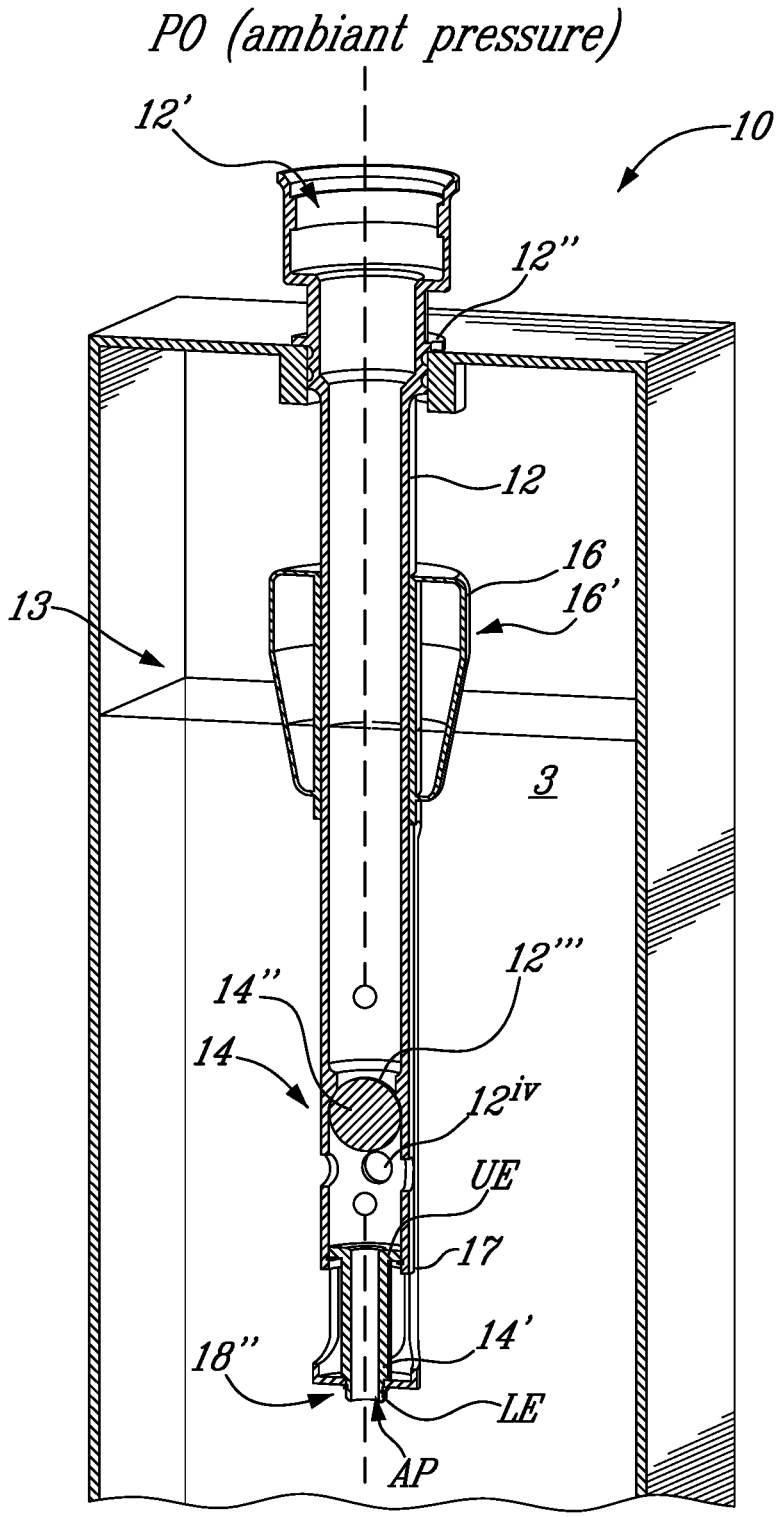
FIG. 5B is a schematic cross sectional view of the oil tank and the aircraft engine oil filler apparatus of FIG. 1, with pressure inside the oil tank being greater than pressure inside an upper empty portion of a filler tube of the aircraft engine oil filler apparatus.

Now referring to FIG. 5A, as the oil 3 fills the oil tank 1 and reaches the level 16' on the float 16, the float 16 starts moving upward, as shown with arrow 20, with the rising level of oil 3. In other words, when the oil 3 is at the level 16', the buoyancy force applied by the float 16 on the telescoping piston 13 equals the weight of the telescoping piston 13. As the oil 3 keeps rising, the float 16 rises with the oil 3. The float 16 thereby starts correspondingly moving the valve 14 upward 20, with the rising level of oil 3. The float 16 continues moving up as long as oil 3 is being poured into the oil tank 1 until the ball 14" seats into/on the seat 12'''. More particularly, and now referring to FIG. 6, when the oil 3 in the oil tank 1 reaches the pre-determined oil level 4, the valve 14 reaches a closed position (CP) in which the ball 14" is pressed, by the upward buoyancy force 20 transmitted from the float 16 to the rod 14' via the links 17, against and into the seat 12''' above the apertures $\mathbf{12}^{iv}$.

More particularly, in the closed position (CP), the ball 14" removably mates with/removably abuts the seat 12''' and hydraulically blocks the filler tube 12 at the seat 12'''. The valve 14 thereby hydraulically disconnects the portion of the filler tube 12 above the seat 12''' from the oil tank 1 and prevents any additional oil that may be added to the filler tube 12 above the seat 12''' from flowing into the oil tank 1. It is contemplated that in some embodiments, the seat 12''' may be omitted and the ball 14" (or other closure member used instead of or in addition to the ball 14") may be shaped to conform to the inner diameter of the filler tube 12 so as to hydraulically block the filler tube 12 at whichever location the ball/closure member 14" is located.

In such embodiments, and as shown in FIG. 2 for example, the length(s) of the filler tube 12 inside the oil tank 1 and/or of the rod 14' and/or of the link(s) 17 may be selected such that the ball/closure member 14" is below the apertures $\mathbf{12}^{iv}$ when the valve 14 is in the open position (OP) to fluidly connect the portion of the filler tube 12 that is above the apertures $\mathbf{12}^{iv}$ to the oil tank 1 via the apertures $\mathbf{12}^{iv}$.

Figure 6:
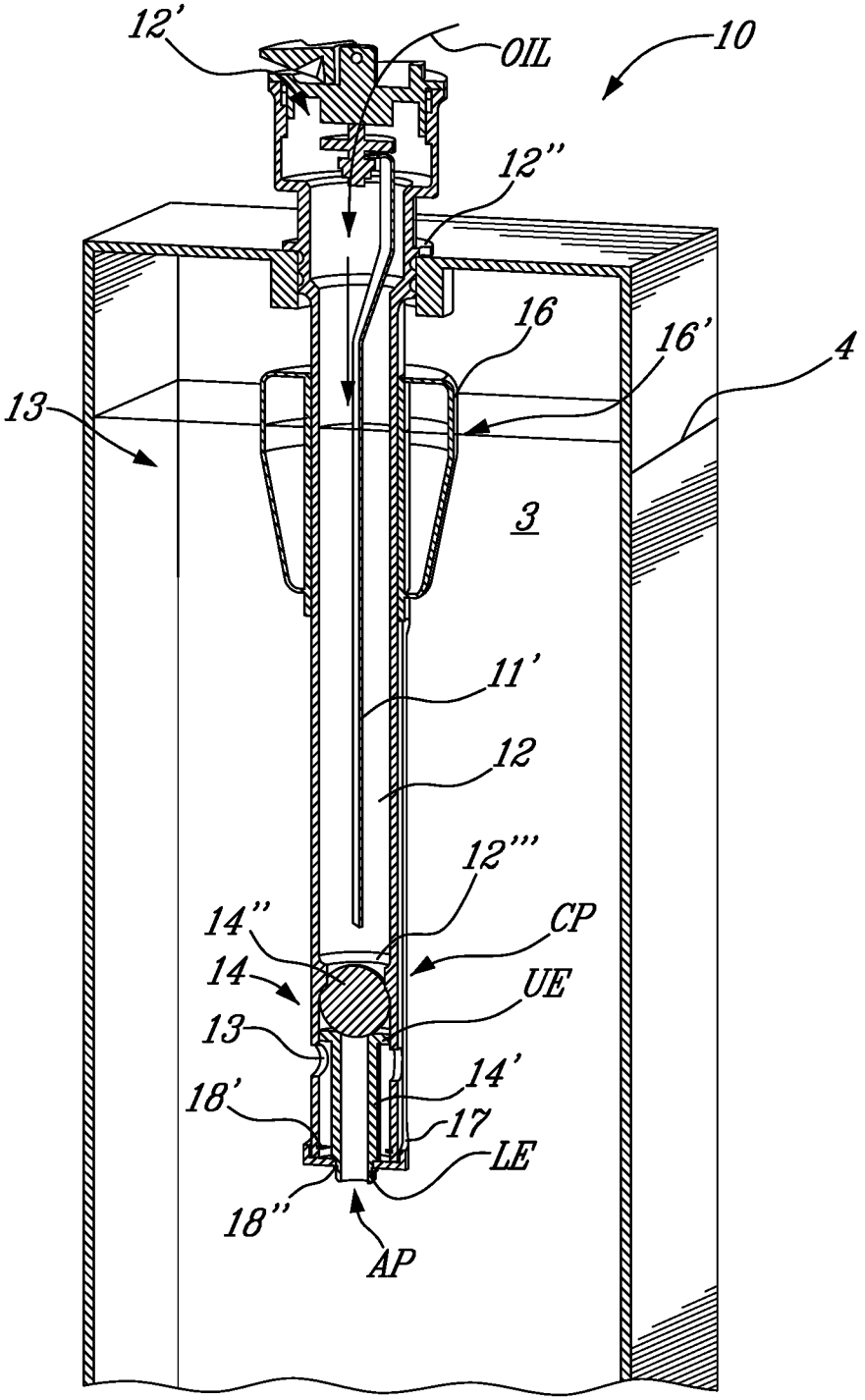
FIG. 6 is a schematic cross sectional view of the oil tank and the aircraft engine oil filler apparatus of FIG. 1, with oil in the oil tank being at a fourth level and the valve being in a closed position.

In such embodiments, and as shown in FIG. 6 for example, the one or more length(s) described above may be selected such that the ball/closure member 14" is moved to a position above the apertures $\mathbf{12}^{iv}$ when the valve 14 is moved to the closed position (CP), to hydraulically disconnect the portion of the filler tube 12 that is above the apertures $\mathbf{12}^{iv}$ from the oil tank 1. In some such embodiments, the ball/closure member 14" may be attached to the rod 14' so as to be moved back, by being acted on by the telescoping piston 13, to a position below the apertures $\mathbf{12}^{iv}$ when the level of oil 3 in the oil tank 1 drops below the pre-determined oil level 4.

For simplicity, hydraulically disconnecting the relevant portion (whether the portion above the apertures $\mathbf{12}^{iv}$ or the portion above the seat 12'") of the filler tube 12 from the oil tank 1 as described above in the different embodiments above is further referred to as "hydraulically disconnecting the filler tube 12 from the oil tank 1".

Also, because in the various embodiments described above the valve 14 may be operated by the telescoping piston 13 which includes at least one float 16, the valve 14 may be referred to as a float valve. However, in this embodiment, the valve 14 itself does not float in the oil 3 (i.e. it is made from material(s), such as any suitable conventional material(s), that is/are more dense than the oil 3).

In some embodiments, such as embodiments in which the ball/closure member 14" may be attached to the rod 14', the ball/closure member 14" and/or the rod 14' may be made from any other suitable material(s), including material(s) of lower density than the oil 3 with which the valve 14 is to be used, so long as the material(s) is/are not so light as to cause the valve 14 to move to its closed position (CP) by floatation of the valve 14 itself without being brought up by the float(s) 16 as described herein. In other embodiments, the valve 14 may be a different type of valve 14, such as a pivotable valve that may pivot relative to the filler tube 12 between the closed position (CP) and the open position (OP).

Figure 7:
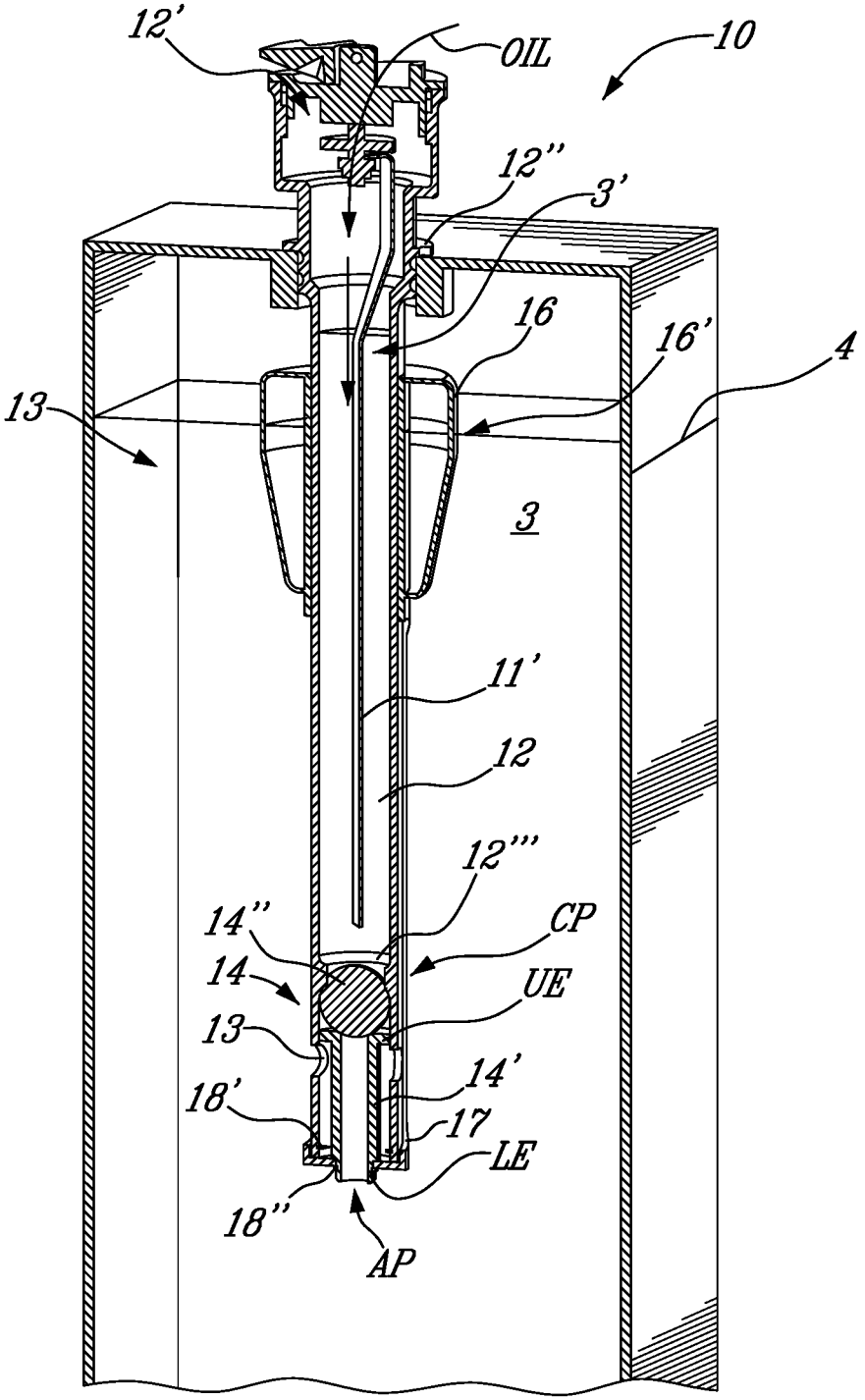
FIG. 7 is a schematic cross sectional view of the oil tank and the aircraft engine oil filler apparatus of FIG. 1, with oil in the oil tank being the fourth level, with the valve being in the closed position, and with additional oil poured into the aircraft engine oil filler apparatus being contained inside the aircraft engine oil filler apparatus.

As described above, the valve 14 by moving into the closed position (CP) prevents the oil tank 1 from being overfilled. Stated otherwise, the closed position (CP) of the valve 14 defines the oil level 4 to which the oil tank 1 may be filled. As shown in FIG. 7, if additional oil 3' is poured into the filler tube 12, the additional oil 3' will collect and remain in the filler tube 12 at levels above the pre-determined oil level 4 in the oil tank 1, and will not flow into the oil tank 1 to overfill the oil tank 1. If the oil tank 1 is flipped upside down, e.g., in flight, the valve 14 maintains the hydraulic disconnection/separation, by gravity instead of buoyancy.

Referring back to FIG. 3B, although this may not be the case in some embodiments, in the present embodiment, the rod 14' is hollow (i.e. defines an axial aperture therethrough which may be aligned with the ball 14"). In an aspect, the decoupled relationship between the rod 14' and the ball 14" described above, together with the rod 14' being hollow, helps the ball 14" to be moved into the seat 12'" by oil 3 movement while the valve 14 is in the open position (OP) in case the oil tank 1 is tilted or overturned for example. This may help at least reduce an amount of oil 3 that may unintentionally exit the oil tank 1 via the filler tube 12 while the oil tank 1 is in use in an aircraft.

In some embodiments in which the ball 14", or other closure member used instead of the ball 14", may be connected to the rod 14', the materials of the valve 14 may be selected such that the valve 14 together with the telescoping piston 13 may move to the closed position (CP) in case the oil tank 1 is tilted or flipped over for example, and may thereby at least reduce an amount of oil 3 that may unintentionally exit the oil tank 1 via the filler tube 12. In some embodiments, such functionality may not be required, as the upper open end 12' of the filler tube 12 may be sealed with the cap 11 prior to, and hence at all times during, flight.

The dimensioning of the parts of each particular embodiment of the filler tube 12 and the telescoping piston 13 relative to each other and/or relative to the dimensions of each particular embodiment of oil tank 1 with which the aircraft engine oil filler apparatus 10 may be used, may be selected to pre-define the particular oil level 4 up to which each particular embodiment of oil tank 1 may be filled.

As a non-limiting example, a length of the links 17 of the telescoping piston 13 and/or a length of the portion of the filler tube 12 that is disposed inside the oil tank 1 may be increased to increase the oil level 4 to which the oil tank 1 may be filled. As another non-limiting example, the length of the links 17 and/or that portion of the filler tube 12 may be decreased, to reduce the oil level 4 to which the oil tank 1 may be filled.

While the aircraft engine oil filler apparatus 10 of the present technology is illustrated as being used with the oil tank 1, the aircraft engine oil filler apparatus 10 of the present technology may also be used with a different type of vessel containing a liquid, such as with a fuel tank for example. In such a different application, the aircraft engine oil filler apparatus 10 may thus be used as an aircraft engine fuel filler apparatus 10. The oil tank 1 may therefore be any suitable oil tank, or any other suitable vessel, including a fuel tank. The oil (or other) tank 1 may be of any suitable construction, and may be a conventional tank and/or vessel needing to be filled with liquid from time to time.

The aircraft engine oil filler apparatus 10 of the present technology may be constructed using any combination of materials and using any manufacturing method that are suitable for each particular embodiment and application of the apparatus 10. For example, in the oil tank 1 application described above, the aircraft engine oil filler apparatus 10 may be injection molded out of plastic(s) that do/does not degrade as a result of contact with the oil 3 with which the oil tank 1 is to be filled. As another example, in some such embodiments, the clip(s) 18', 18" may be made of an aluminum alloy.

Figure 8:
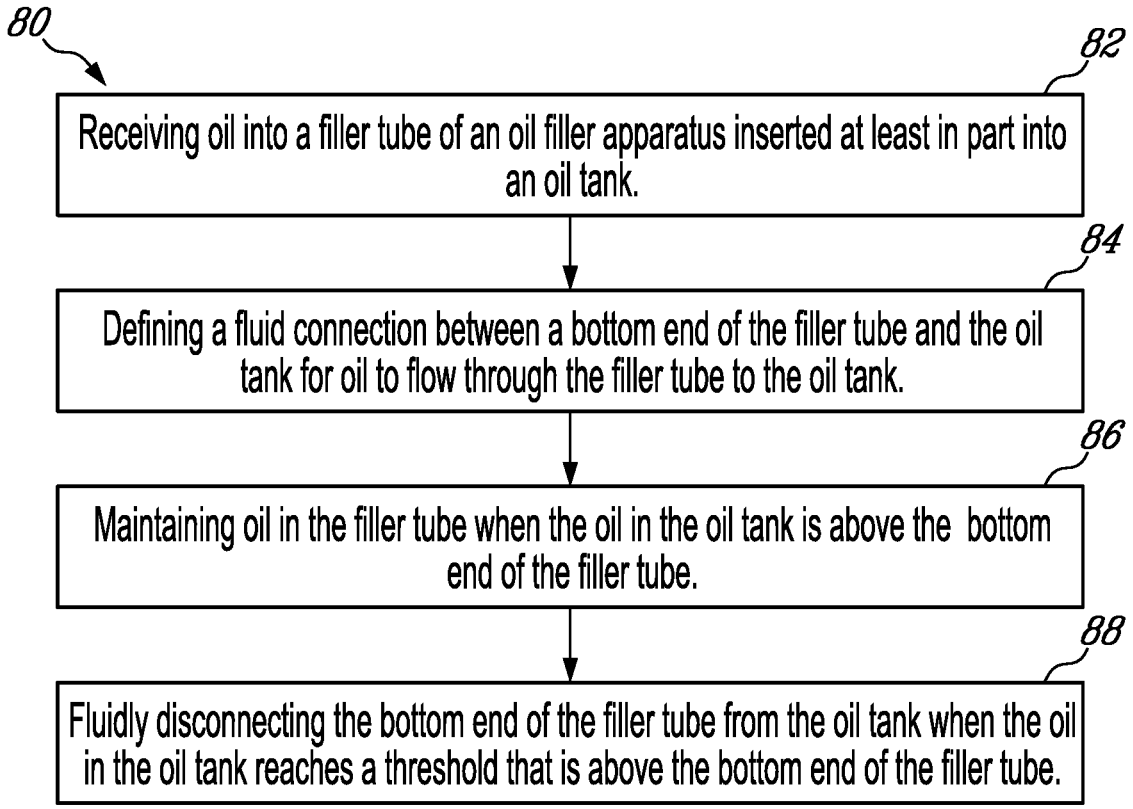
FIG. 8 is a diagram showing a method of operation of an oil filler apparatus.

With the above structure in mind, and now referring to FIG. 8, the present technology provides a method 80 of operation of an oil filler apparatus 10. As seen above, in some embodiments, the method 80 may include a step 82 of receiving oil into a filler tube 12 of the oil filler apparatus 10 inserted at least in part into an oil tank 1 of an aircraft. In some embodiments, the oil tank 1 may be a part of an engine 1A of the aircraft, while in other embodiments it may be a different oil tank. Also as seen with the structure above, in some embodiments the method 80 may also include a step 84 of defining a fluid connection, such as via one or more apertures $12^1$, between a bottom end of the filler tube 12 and the oil tank 1 for oil 3 to flow through the filler tube 12 to the oil tank 1. The method 80 may also include a step 86 of maintaining oil 3 in the filler tube 12 when the oil 3 in the oil tank 1 is above the bottom end of the filler tube 12, such that a level of oil in the filler tube 12 is at least approximately equal to and rises together with a level of oil in the oil tank 1.

The method 80 may further include a step 88 of fluidly disconnecting the bottom end of the filler tube 12 from the oil tank 1 when the oil 3 in the oil tank 1 reaches a threshold that is above the bottom end of the filler tube 12. For example, in some embodiments, the threshold may be an established maximum desired oil level in a given oil tank 1 for a given one or more applications of the given oil tank 1. As seen above, in some embodiments, the fluidly disconnecting the bottom end of the filler tube 12 from the oil tank 1 may include seating a closure member 14", such as the ball 14" for example, against the filler tube 12. In some embodiments, the fluidly disconnecting step 88 involves seating the ball 14" into the seat $12^{iv}$ of the filler tube 12. In some embodiments, the seating the closure member 14" may include translating the closure member 14", such as translating the ball 14" inside the filler tube 12 into the seat $12^{iv}$ for example. In such embodiments, the seating the closure member 14" may include blocking an inner diameter of the filler tube 12. Also as seen above, in such embodiments, the seating the closure member 14" may include telescoping a piston 13 relative to the filler tube 12. In some such embodiments, the telescoping the piston 13 may include translating a rod 14' in the bottom end of the filler tube 12.

As seen above, in some embodiments, the telescoping the piston 13 may include applying a buoyancy force, for example via a float 16, to the rod 14' to push the closure member 14" with the rod 14'. 17. In some embodiments, the method 80 further comprises receiving a dipstick 11' in the filler tube 12. As seen above, in some embodiments, the receiving the dipstick 11' occurs after the receiving oil 3 into the filler tube 12 but before the step 88 of fluidly disconnecting the bottom end of the filler tube 12 from the oil tank 1. Also as seen above, in some embodiments, the receiving the dipstick 11' occurs after the step 88 of fluidly disconnecting the bottom end of the filler tube 12 from the oil tank 1. Yet further as seen above, in some embodiments, the method 80 also further comprises receiving a cap 11 on the filler tube 12 and in some such embodiments the receiving the cap 11 includes receiving the dipstick 11' in the filler tube 12.

Yet further as seen above, in some embodiments, the method 80 may further comprise hydraulically disconnecting the filler tube 12 from the oil tank 1 when pressure in the filler tube 12 is smaller than pressure in the oil tank 1, and hence smaller than pressure in the rod 14', such as may occur when the cap 11 is mis-installed or missing or otherwise compromised in operation for example. That is, as shown in FIG. 5B for example, when the cap 11 is properly installed and seals the upper open end 12' of the filler tube 12 and the oil tank 1 is in operation (e.g. in flight), in at least some embodiments of oil tanks, pressure inside the filler tube 12 may be equal to pressure inside the oil tank 1. If and when the cap 11 is removed or otherwise compromised, the pressure in the filler tube 12 may drop to, for example, ambient pressure, which may be lower than pressure in the oil tank 1.

In at least some such cases, and depending on the pressure differential created, the pressure differential may cause oil 3 in the oil tank 1 to be pushed into the filler tube 12 via the aperture in the rod 14'. This flow may move the ball 14" into the seat 12'" and thereby hydraulically disconnect the filler tube 12 from the oil tank 1. Stated otherwise, the aperture(s) $12^{iv}$ and the aperture through in rod 14' may be sized such that when the pressure in the oil tank 1 becomes greater than the pressure in the upper empty portion of the filler tube 12, a flow of oil 3 may be induced through the aperture in the rod 14' toward the ball 14" and the flow may move the ball 14" into the seat 12'. Once the ball 14" is in the seat 12'", the ball 14" may be kept in the seat 12' by the pressure differential across the ball 14", such as until for example the pressure differential is removed.

The above description is meant to be exemplary only, and one skilled in the art will recognize that changes may be made to the embodiments described without departing from the scope of the technology disclosed herein. For example, the link(s) 17 may be structured, using any suitable construction for example, to be selectively adjustable in length, to allow for the oil level 4 in the oil tank 1 to be adjustable simply by adjusting the length of the link(s) 17. As another example, multiple floats 16 may be used to provide for the functionality described herein.

Still other modifications which fall within the scope of the present technology will be apparent to those skilled in the art, in light of a review of this disclosure, and such modifications are intended to fall within the appended claims.

The invention claimed is:

1. An aircraft engine oil filler apparatus, comprising:

a filler tube configured to be received through a wall of an oil tank of an aircraft engine such that an open upper end of the filler tube is accessible from outside of the oil tank and a bottom end of the filler tube is disposed inside the oil tank;

a valve received at least in part in the bottom end of the filler tube and movable between an open position in which the valve hydraulically connects the filler tube to the oil tank, and a closed position in which the valve hydraulically disconnects the filler tube from the oil tank;

a float disposed above the valve and operatively connected to the valve to move the valve from the open position to the closed position when oil inside the oil tank rises to a predetermined level; and a dipstick removably received in the filler tube, the dipstick having a length selected such that a bottom end of the dipstick is disposed above the valve.

2. The aircraft engine oil filler apparatus of claim 1, comprising a link connecting the float to the valve.

3. The aircraft engine oil filler apparatus of claim 2, wherein the valve includes a ball and a rod translationally received in the filler tube, the rod being connected to the link to translate relative to the filler tube with the float.

4. The aircraft engine oil filler apparatus of claim 3, wherein the filler tube defines an aperture in the filler tube below the float and the valve includes a closure member disposed below the aperture when the valve is in the open position.

5. The aircraft engine oil filler apparatus of claim 4, comprising a seat disposed inside the filler tube above the aperture, and the closure member is received in the seat and thereby blocks the filler tube above the aperture when the valve is in the closed position.

6. The aircraft engine oil filler apparatus of claim 5, where the bottom end of the dipstick is disposed above the seat.

7. An oil tank of an aircraft engine, comprising:

a filler tube received through a wall of the oil tank such that an upper end of the filler tube is accessible from outside of the oil tank and a bottom end of the filler tube is disposed inside the oil tank, the filler tube defining apertures in the bottom end;

a valve received at least in part in the bottom end of the filler tube, the valve being operable between an open position in which the valve hydraulically connects a portion of the filler tube above the apertures to the inside of the oil tank via the apertures, and a closed position in which the valve blocks the apertures and thereby hydraulically disconnects the portion of the filler tube above the apertures from the inside of the oil tank; and a float disposed inside the oil tank above the valve and operatively connected to the valve to move the valve from the open position to the closed position when oil inside the oil tank rises to a predetermined level.

8. The oil tank of claim 7, wherein the valve is disposed below the apertures when in the open position and above the apertures when in the closed position.

9. The oil tank of claim 8, comprising a dipstick removably received in the filler tube such that a bottom end of the dipstick is above the valve both when the valve is in the open position and when the valve is in the closed position.

10. A method of operation of an oil filler apparatus, comprising:

receiving oil into a filler tube of the oil filler apparatus inserted at least in part into an oil tank of an aircraft, defining a fluid connection between a bottom end of the filler tube and the oil tank for oil to flow through the filler tube to the oil tank;

maintaining oil in the filler tube when the oil in the oil tank is above the bottom end of the filler tube; and fluidly disconnecting the bottom end of the filler tube from the oil tank when the oil in the oil tank reaches a threshold that is above the bottom end of the filler tube, wherein fluidly disconnecting the bottom end of the filler tube from the oil tank includes seating a closure member against the filler tube, wherein seating the closure member includes telescoping a piston relative to the filler tube.

11. The method of claim 10, wherein the seating the closure member includes translating the closure member.

12. The method of claim 10, wherein the seating the closure member includes blocking an inner diameter of the filler tube.

13. The method of claim 10, wherein the telescoping the piston includes translating a rod in the bottom end of the filler tube.

14. The method of claim 13, wherein the telescoping the piston includes applying a buoyancy force to the rod to push the closure member with the rod.

15. The method of claim 14, comprising hydraulically disconnecting the filler tube from the oil tank when pressure in the filler tube is smaller than pressure in the rod.

16. The method of claim 15, comprising receiving a dipstick in the filler tube after the receiving oil into the filler tube but before the fluidly disconnecting the bottom end of the filler tube from the oil tank.

17. The method of claim 16, further comprising receiving a cap on the filler tube and wherein the receiving the cap includes receiving the dipstick in the filler tube.

18. The method of claim 15, wherein the receiving the dipstick occurs after fluidly disconnecting the bottom end of the filler tube from the oil tank.

* * * * *